US009080746B2

(12) United States Patent
Chen et al.

(10) Patent No.: US 9,080,746 B2
(45) Date of Patent: Jul. 14, 2015

(54) LED ASSEMBLY HAVING A REFRACTOR THAT PROVIDES IMPROVED LIGHT CONTROL

(71) Applicant: ABL IP HOLDING LLC, Conyers, GA (US)

(72) Inventors: Jie Chen, Snellville, GA (US); Craig Eugene Marquardt, Covington, GA (US); Daniel Aaron Weiss, Tucker, GA (US); Daniel Vincent Sekowski, Loganville, GA (US); Yaser S. Abdelsamed, Granville, OH (US)

(73) Assignee: ABL IP HOLDING LLC, Conyers, GA (US)

( * ) Notice: Subject to any disclaimer, the term of this patent is extended or adjusted under 35 U.S.C. 154(b) by 0 days.

(21) Appl. No.: 13/837,731

(22) Filed: Mar. 15, 2013

(65) Prior Publication Data

US 2014/0268811 A1 Sep. 18, 2014

(51) Int. Cl.

| | |
|---|---|
| ***F21V 7/00*** | (2006.01) |
| ***F21V 13/04*** | (2006.01) |
| ***F21V 5/04*** | (2006.01) |

(Continued)

(52) U.S. Cl.

CPC . *F21V 13/04* (2013.01); *F21V 5/04* (2013.01); *F21V 5/08* (2013.01); *F21Y 2101/02* (2013.01)

(58) Field of Classification Search

CPC ..... F21V 5/04; F21V 13/02; F21V 13/04; F21V 13/10; F21V 13/12; F21V 14/00; F21W 2131/103; F21Y 2101/02; F21K 9/00

USPC ..... 362/555, 244, 245, 248, 308, 311.01, 362/311.02, 328

See application file for complete search history.

(56) References Cited

U.S. PATENT DOCUMENTS

| | | | |
|---|---|---|---|
| 1,551,274 | A | 8/1925 | Townsend |
| 2,170,912 | A | 8/1939 | Rolph |
| 2,662,165 | A | 12/1953 | Franck |

(Continued)

FOREIGN PATENT DOCUMENTS

| | | | |
|---|---|---|---|
| JP | 2004/288866 | A | 10/2004 |
| WO | 2011/100756 | A1 | 8/2011 |
| WO | 2014145802 | | 9/2014 |

OTHER PUBLICATIONS

Non-Final Office Action received in U.S App. No. 13/838,139 mailed on Jun. 20, 2014, 13 pages.

(Continued)

*Primary Examiner* — Thomas A Hollweg

(74) *Attorney, Agent, or Firm* — Kilpatrick Townsend & Stockton LLP

(57) ABSTRACT

An LED assembly that includes optics and optical arrangements for light emitting diodes (LEDs). In some embodiments, a reflector is provided within a void between the lens and the LED. This reflector can reflect light emitted by the LED in a non-preferred direction back toward the preferred direction. In other embodiments, an optical element is formed or otherwise provided in the lens cavity and shaped so that, when the lens is positioned above the LED, the refractor bends the emitted light in a preferred direction. In some embodiments, both a reflector and optical element are provided in the LED assembly to control the directionality of the emitted light. Such embodiments of the invention can be used to increase the efficiency of an LED by ensuring that generated light is being directed to the target area of choice.

18 Claims, 13 Drawing Sheets

(51) Int. Cl.
*F21V 5/08* (2006.01)
*F21Y 101/02* (2006.01)

(56) References Cited

U.S. PATENT DOCUMENTS

| | | | | |
|---|---|---|---|---|
| 3,191,022 | A | 6/1965 | Wince | |
| 3,278,743 | A | 10/1966 | Franck | |
| 3,283,140 | A | 11/1966 | Rex | |
| 3,340,393 | A | 9/1967 | Franck et al. | |
| 3,459,936 | A | 8/1969 | Miller | |
| 3,524,051 | A | 8/1970 | Baldwin et al. | |
| 3,679,889 | A | 7/1972 | Franck | |
| 3,766,375 | A | 10/1973 | Edman et al. | |
| 4,085,318 | A | 4/1978 | Odle et al. | |
| 4,451,875 | A | 5/1984 | Odle et al. | |
| 5,130,761 | A | 7/1992 | Tanaka | |
| 5,481,445 | A | 1/1996 | Sitzema et al. | |
| 5,929,788 | A | 7/1999 | Vukosic | |
| 6,095,663 | A | 8/2000 | Pond et al. | |
| 6,971,772 | B1 | 12/2005 | Abdelsamed et al. | |
| 7,055,996 | B2 | 6/2006 | Pond et al. | |
| 7,245,203 | B2 | 7/2007 | Stephens et al. | |
| 7,347,586 | B2 | 3/2008 | Izardel | |
| 7,445,359 | B2 | 11/2008 | Chang | |
| 7,445,362 | B2 | 11/2008 | Compton et al. | |
| 7,566,911 | B2 | 7/2009 | Jyo | |
| 7,798,678 | B2 | 9/2010 | Destian | |
| 7,854,536 | B2 | 12/2010 | Holder et al. | |
| 7,891,835 | B2 | 2/2011 | Wilcox | |
| 7,896,532 | B2 | 3/2011 | Hsu et al. | |
| 7,959,326 | B2 | 6/2011 | Laporte | |
| 8,167,463 | B2 | 5/2012 | Loh | |
| 8,267,553 | B2 | 9/2012 | Liang et al. | |
| 8,282,239 | B2 | 10/2012 | Wilcox | |
| 8,348,475 | B2 * | 1/2013 | Wilcox et al. | 362/332 |
| 8,434,912 | B2 * | 5/2013 | Holder et al. | 362/311.1 |
| 8,439,525 | B2 | 5/2013 | Abdelsamed et al. | |
| 8,511,854 | B2 * | 8/2013 | Wilcox | 362/245 |
| 8,511,864 | B2 * | 8/2013 | Holder et al. | 362/311.02 |
| 8,628,222 | B2 * | 1/2014 | Kelley | 362/335 |
| 2003/0063476 | A1 | 4/2003 | English et al. | |
| 2006/0072314 | A1 | 4/2006 | Rains | |
| 2007/0019416 | A1 | 1/2007 | Han et al. | |
| 2007/0242441 | A1 | 10/2007 | Aldrich | |
| 2007/0284592 | A1 | 12/2007 | Haase | |
| 2008/0239722 | A1 * | 10/2008 | Wilcox | 362/268 |
| 2009/0225551 | A1 | 9/2009 | Chang et al. | |
| 2009/0295266 | A1 | 12/2009 | Ramer et al. | |
| 2009/0316384 | A1 | 12/2009 | Kanayama et al. | |
| 2010/0014290 | A1 * | 1/2010 | Wilcox | 362/244 |
| 2010/0033985 | A1 | 2/2010 | Hsu et al. | |
| 2010/0039810 | A1 * | 2/2010 | Holder et al. | 362/235 |
| 2011/0089453 | A1 | 4/2011 | Min | |
| 2011/0122619 | A1 * | 5/2011 | Wilcox | 362/245 |
| 2011/0141734 | A1 | 6/2011 | Li et al. | |
| 2011/0215721 | A1 | 9/2011 | Rains, Jr. et al. | |
| 2012/0002412 | A1 | 1/2012 | Cheng | |
| 2012/0026732 | A1 | 2/2012 | Fricke | |
| 2012/0050889 | A1 | 3/2012 | Lu et al. | |
| 2012/0195040 | A1 | 8/2012 | Treanton | |
| 2012/0212138 | A1 | 8/2012 | Jungwirth | |
| 2012/0287649 | A1 | 11/2012 | Kelley | |
| 2012/0300488 | A1 | 11/2012 | Broughton | |
| 2012/0316384 | A1 | 12/2012 | Arnold | |
| 2013/0027932 | A1 * | 1/2013 | Wilcox | 362/245 |
| 2013/0335968 | A1 * | 12/2013 | Wilcox | 362/237 |

OTHER PUBLICATIONS

Response to Office Action in U.S. Appl. No. 13/838,139, mailed on Nov. 20, 2014, 17 pages.
Unknown, "Raydian SL LightBar M1035 version," Federal Signal corporation, Publication date: 2006, retrieved on Dec. 19, 2014, 1 page.
Final Office Action for U.S. Appl. No. 13/838,139, mailed Jan. 21, 2015, 27 pages.
International Search Report and Written Opinion for application No. PCT/US2014/030628, mailed Oct. 14, 2014, 11 pages.

* cited by examiner

Preferred
Light
direction

LED ASSEMBLY HAVING A REFRACTOR THAT PROVIDES IMPROVED LIGHT CONTROL

BACKGROUND

Light emitting diodes (LEDs) are used in a variety of general lighting applications such as streetlights, parking garage lighting, and parking lots. LEDs have reached efficiency values per watt that outpace almost all traditional light sources. LEDs, however, can be expensive in lumens per dollar compared to light sources. Because of the high cost of using LEDs, optical, electronic and thermal efficiencies can be very important. In direction lighting applications, such as street lighting, it is inefficient to illuminate the house side of the street rather than direct all the light toward the street. Total internal reflection (TIR) lenses have been used to successfully direct house-side light toward the street. But these TIR solutions are still not very efficient.

BRIEF SUMMARY

This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to the entire specification of this patent, all drawings and each claim.

Embodiments of the invention include an LED assembly that includes optics and optical arrangements for light emitting diodes (LEDs). In some embodiments, a reflector is provided within a void between the lens and the LED. This reflector can reflect light emitted by the LED in a non-preferred direction back toward the preferred direction. In other embodiments, an optical element is formed or otherwise provided in the lens cavity and shaped so that, when the lens is positioned above the LED, the refractor bends the emitted light in a preferred direction. In some embodiments, both a reflector and optical element are provided in the LED assembly to control the directionality of the emitted light. Such embodiments of the invention can be used to increase the efficiency of an LED by ensuring that generated light is being directed to the target area of choice.

BRIEF DESCRIPTION OF THE DRAWINGS

Illustrative embodiments of the present invention are described in detail below with reference to the following drawing figures.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the invention include an LED assembly that includes optics and optical arrangements for light emitting diodes (LEDs). In some embodiments, a reflector is provided within a void between the lens and the LED. This reflector can reflect light emitted by the LED in a non-preferred direction back toward the preferred direction. In other embodiments, an optical element is formed or otherwise provided in the lens cavity and shaped so that, when the lens is positioned above the LED, the refractor bends the emitted light in a preferred direction. In some embodiments, both a reflector and optical element are provided in the LED assembly to control the directionality of the emitted light. Such embodiments of the invention can be used to increase the efficiency of an LED by ensuring that generated light is being directed to the target area of choice.

Figure 1:
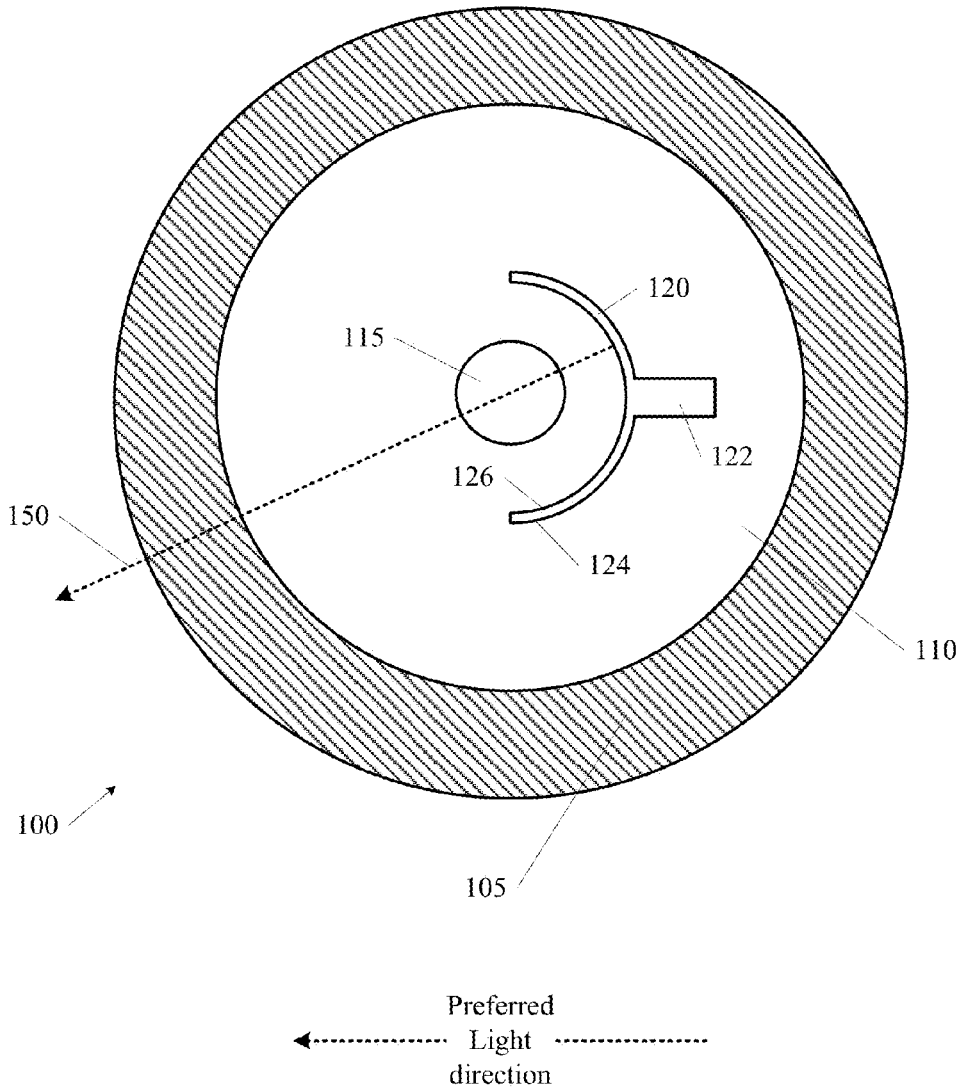
FIG. 1 shows a cross-section of one embodiment of an LED assembly.
Figure 2:
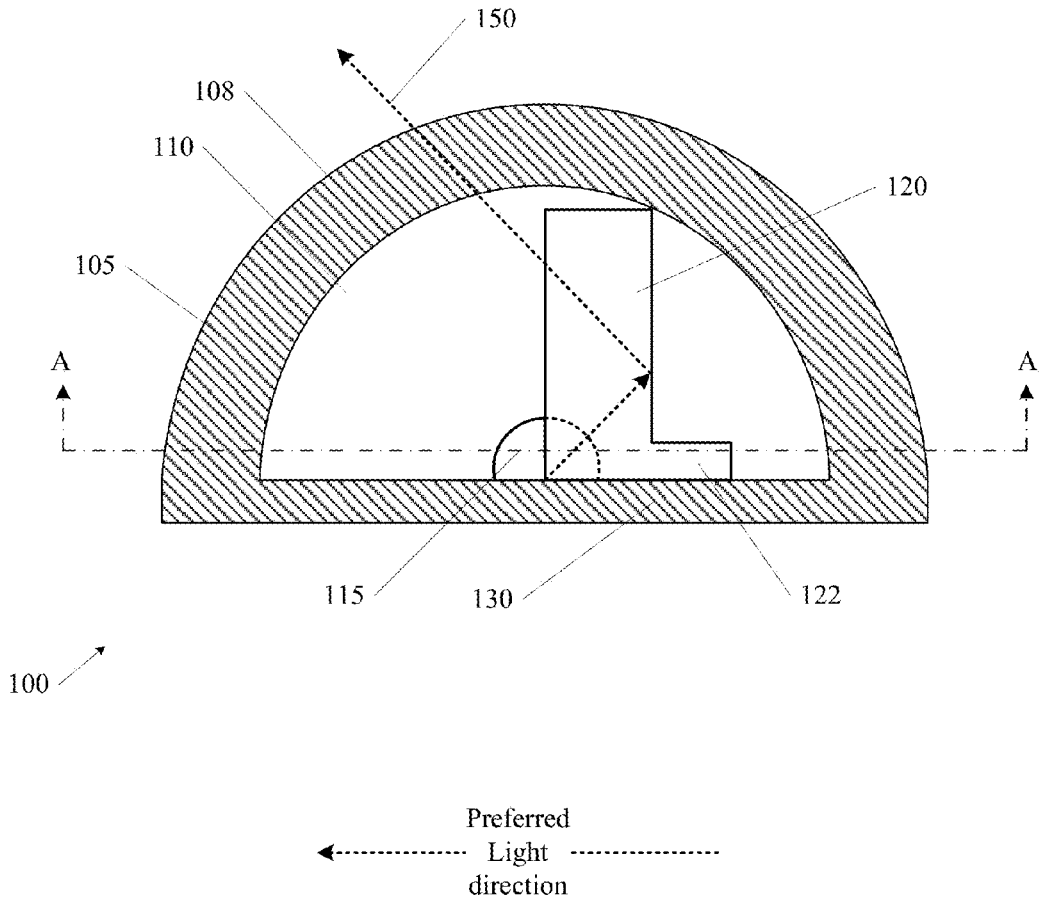
FIG. 2 shows another cross-section of the LED assembly of FIG. 1.
Figure 3:
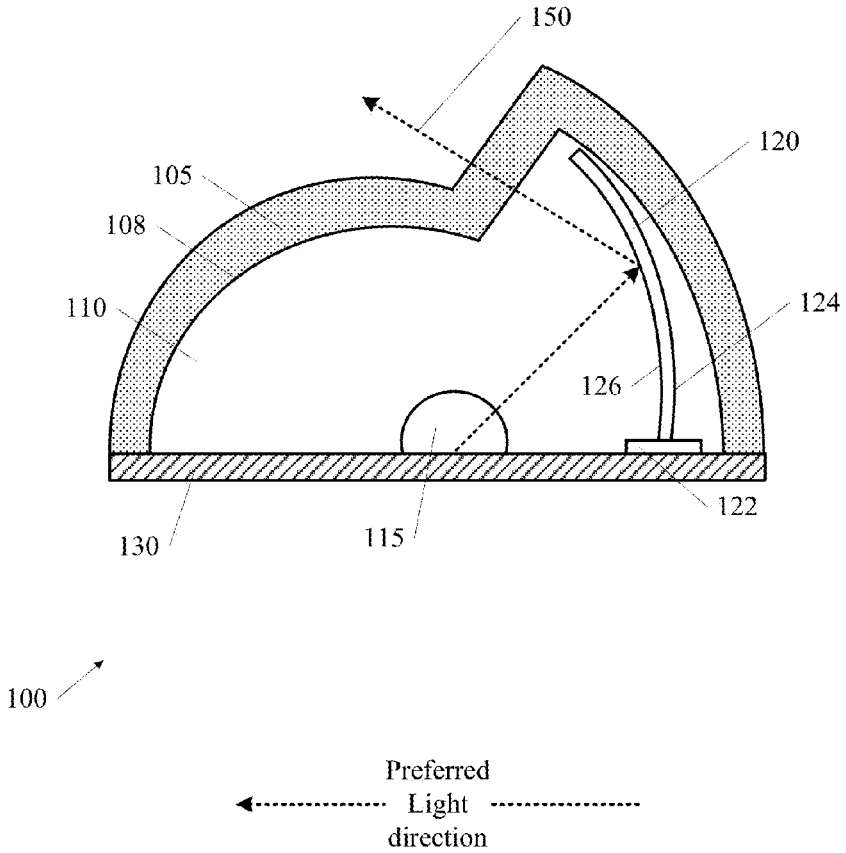
FIG. 3 shows a cross-section of an alternative embodiment of an LED assembly.
Figure 4:
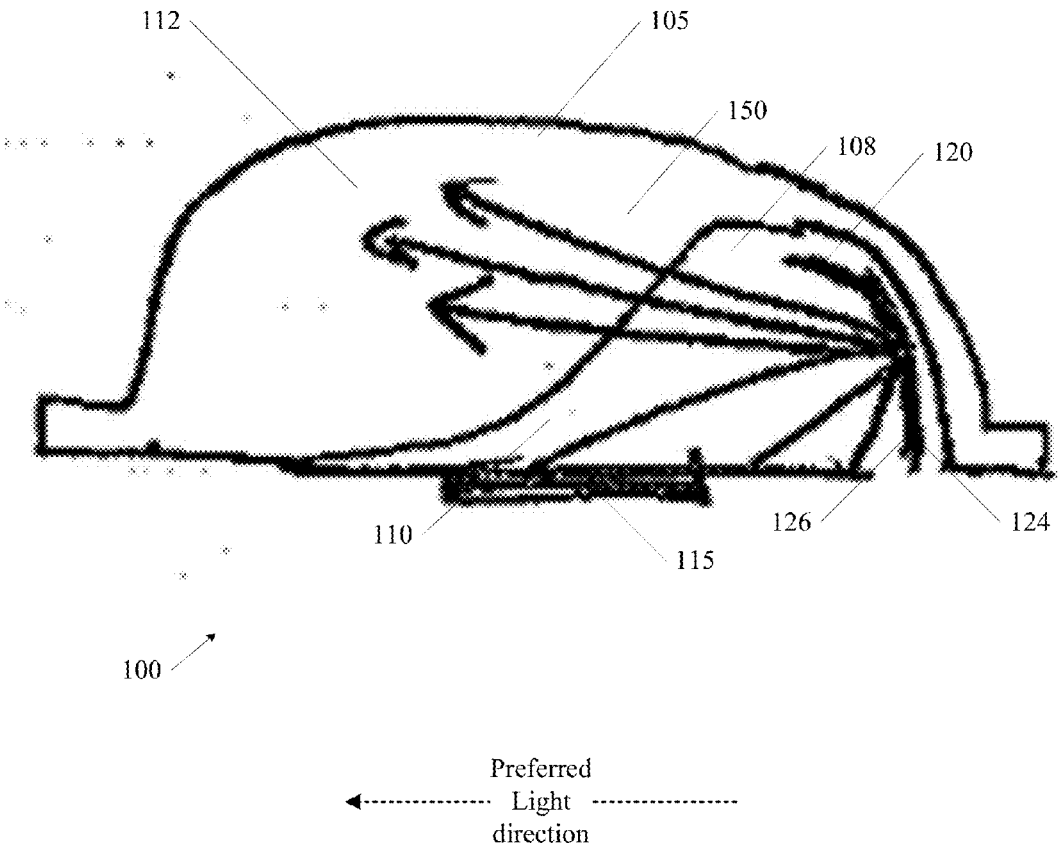
FIG. 4 shows a cross-section of yet another alternative embodiment of an LED assembly.

FIG. 1 shows a top view of an LED assembly 100 cut along line A-A of the cross-sectional view of LED assembly 100 shown in FIG. 2. Referring to both these figures, LED assembly 100 can include light emitter 115 disposed within lens 105 such that a void 110 exists between the lens 105 and light emitter 115 and surrounds light emitter 115. In some embodiments, void 110 can be semi-hemispherical, but void 110 is certainly not intended to be limited to this geometry. Rather, the inner surface 108 of the lens 105, and thus the shape of void 110 dictated by such inner surface 108, can be of any desired shape. For example, FIG. 3 illustrates another embodiment of the LED assembly 100 where the inner surface 108 of the lens 105 is not semi-hemispherical. FIG. 4 illustrates a cross-section of another embodiment of LED assembly 100 where the inner surface 108 of lens 105 is shaped so as to create a thick lens portion 112.

Light emitter 115 can be any type of light emitter known in the art. For example, light emitter 115 can include a light emitter made from Aluminum gallium arsenide (AlGaAs), Gallium arsenide phosphide (GaAsP), Aluminum gallium indium phosphide (AlGaInP), Gallium(III) phosphide (GaP), Aluminum gallium phosphide (AlGaP), Zinc selenide (ZnSe), Indium gallium nitride (InGaN), Silicon carbide (SiC) Silicon (Si), or Indium gallium nitride (InGaN).

In some embodiments, lens 105 can include plastic, glass, silicon, epoxy, or acrylic material. These materials may or may not be optical grade.

Figure 5:
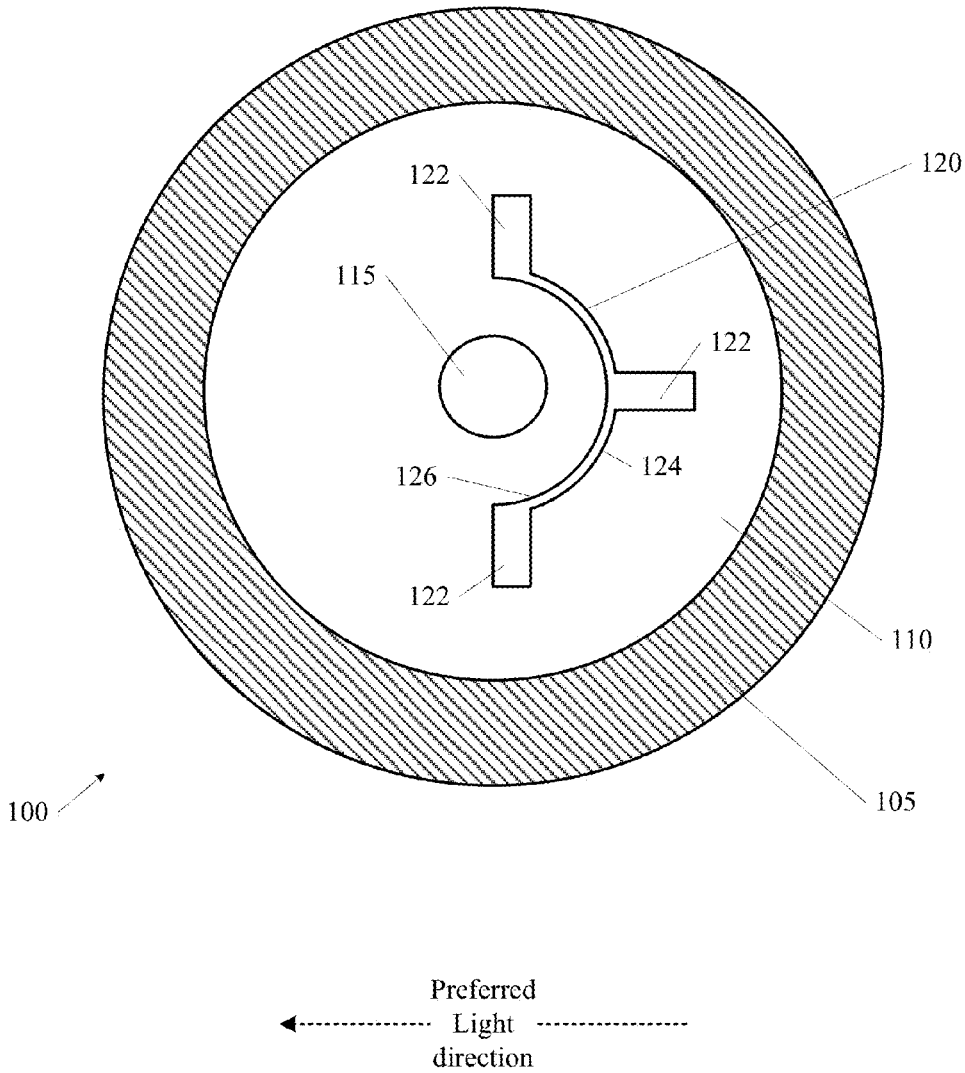
FIG. 5 shows a cross-section of still another alternative embodiment of an LED assembly.
Figure 6:
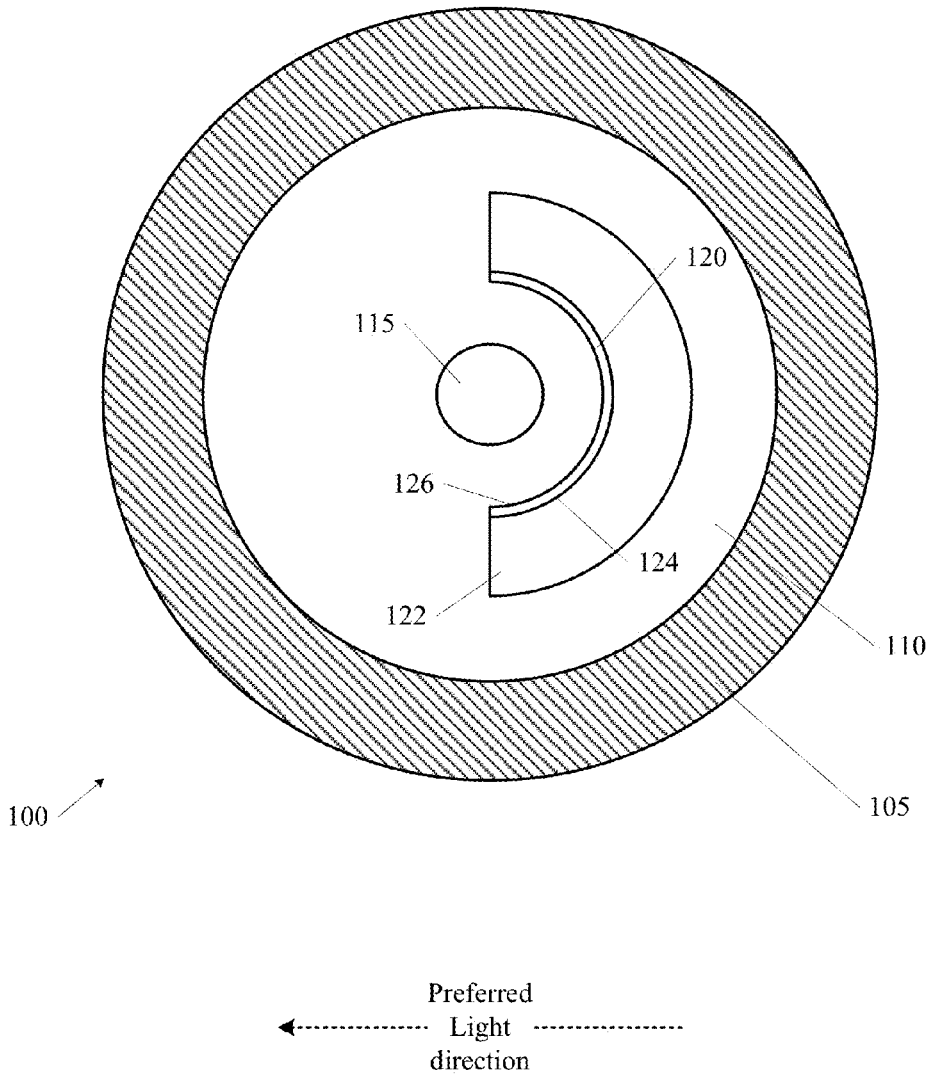
FIG. 6 shows a cross-section of yet another alternative embodiment of an LED assembly.

Embodiments of LED assembly 100 includes reflector 120 that is positioned within the void 110 so as to extend at least partially around the light emitter 115. Retention structure, such as tab 122, can be provided on reflector 120 and used to secure reflector 120 to circuit board 130 within LED assembly 100. The reflector 120 may include more than one tab 122 (see FIG. 5) or the tab may be a continuous tab that extends all the way or partially around the base of reflector 120, as shown in FIG. 6. The tab 122 can have any geometry that permits it to attach the reflector 120 to the circuit board 130. Moreover, any retention structure that permits the reflector 120 to be attached to the circuit board 130 may be used and certainly is not limited to the tab geometry disclosed herein.

Tab 122 can be secured to circuit board 130 using any attachment scheme, for example, using solder, a screw, staple, glue, adhesive, heat bonding, rivets, push tab connectors, slot tab connectors, etc. In some embodiments, reflector 120 can be coupled directly with the top surface of circuit board 130. Using these tabs 122, the reflector 120 is secured directly to circuit board 130 and not to lens 105. In some embodiments, for example, reflector 120 may not be in contact with lens 105.

In some embodiments reflector 120 can be secured to the circuit board using a light emitter holder (e.g., an LED COB array holder). A light emitter holder can be used to secure an LED to a circuit board or a substrate. Some LEDs are powered with contacts that are not soldered to a circuit board. Instead, a light emitter holder can be screwed to the circuit board in such a way to hold and secure the light emitter in place on the circuit board and to keep the necessary electrical contacts in place. Such a light emitter holder can be used to secure the reflector to the circuit board. For instance, the reflector can include tab 122 with a hole that is sized to correspond with the screw (or bolt) that secures light emitter holder into place. Tab 122 can be secured to the circuit board using the same screw that secures the light emitter holder. This screw can pass through the hole in tab 122. Reflector 120 can be placed above or beneath light emitter holder. In some embodiments, reflector 120 can pressed to the circuit board with the light emitter holder with or without the screw passing through tab 122.

Reflector 120 can have shape and/or dimension (e.g., height) that permits the reflector 120 to fit within void 110. In the illustrated embodiment of FIG. 1, the reflector 120 has a semi-circular shape so as to curve around light emitter 115 and azimuthally surround light emitter 115 around 180°. In other examples, reflector 120 can azimuthally surround light emitter 115 around 270°, 225°, 135°, 90°, etc. However, the reflector 120 is not limited to the illustrated semi-circular shape but rather can have any desired shape, including semi-oval or elliptical cross sectional shapes. In some embodiments, reflector 120 may include a continuous curve that wraps around light emitter 115.

While FIG. 1 illustrates the reflector 120 as having a consistent cross-sectional shape (i.e., an inner surface 126 and an outer surface 124 of the same shape), it need not. Rather, the inner surface 126 and outer surface 124 can be of different shapes. The inner surface 126 of the reflector 120 can be of any shape that effectuates the desired reflection of light in a preferred light direction, as discussed below. This includes, but is not limited to, an inner surface 126 having an elliptical, parabolic shape or irregular geometry. In some embodiments, reflector 120 can comprise a plurality of reflectors.

In some embodiments, reflector 120 does not only extend around the light emitter 115 but rather can also extend partially over the light emitter 115 so as to reflect nearly vertical light emitted by the light emitter 115.

The reflector 120 may be formed of any suitable material, including polymeric materials (e.g., optical grade polyesters, polycarbonates, acrylics, etc.) or metallic materials (e.g., prefinished anodized aluminum (e.g. Alanod Miro), prefinished anodized silver (e.g. Alanod Miro Silver), painted steel or aluminum, etc.). Regardless of the material from which the reflector 120 is formed, the inner surface 126 of the reflector should have a high surface reflectivity, preferably, but not necessarily, between 96%-100%, inclusive, and more preferably 98.5-100%, inclusive.

Reflector 120 is shaped and positioned relative to light emitter 115 to direct light from the light emitter 115 in a desired or preferred direction. In use, light emitted from light emitter 115 in a non-preferred direction impinges upon the inner surface 126 of reflector 120, which in turn reflects the light in the preferred direction. For example, light ray(s) 150 exits light emitter 115, hits the inner surface 126 of reflector 120, and is reflected back in the preferred light direction (as viewed from above). Again, the positioning of the reflector 120 within void 110 and the shape of the inner surface 126 of the reflector 120 can be controlled to achieve the desired directionality of the reflected light. In FIG. 4, light rays the light rays 150 are reflected back through thick lens portion 112 toward the preferred light direction. The thickness and/or shape of thick lens portion 112 may be dictated, for example, by the desired outward surface shape and/or any refracting requirements.

Figure 7:
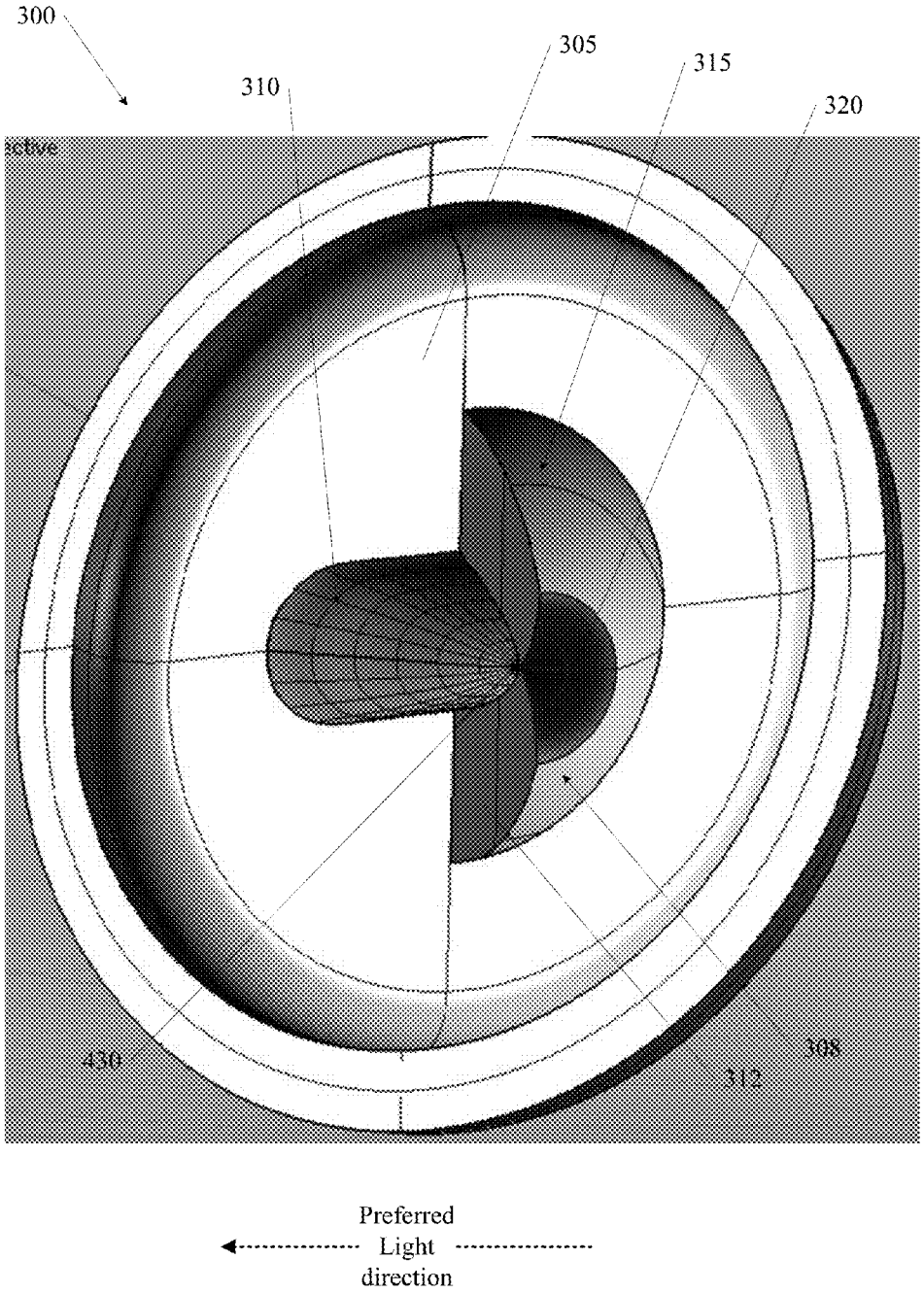
FIG. 7 shows a bottom perspective view of one embodiment of a lens for use in an embodiment of an LED assembly.

FIG. 7 shows the underside of lens 300 according to some embodiments of the invention. Lens 300 includes an outer surface and inner surface 305 that defines a lens cavity 308. The lens cavity 308 can be formed so as to control the directionality of the light emitted from the lens 300.

The lens cavity 308 includes a preferred-side void 310 and non-preferred-side void 315. Each void 310, 315 can be of any shape and is certainly not limited to the geometries shown in the Figures. Non-preferred-side void 315 can have a semi-hemispherical cross-sectional shape or a semi-ovoid cross-sectional shape. Preferred-side void 310 can also have a semi-hemispherical cross-sectional shape or a semi-ovoid cross-sectional shape. Preferred-side void 310 can also have some linear portions or parabolic portions. The two voids 310 and 315 can be cut, etched, or molded into lens 300.

Lens 300 can be positioned over a light emitter or other light source. In some embodiments, the light emitter can be centrally disposed between the two voids 310 and 315. In other embodiments, the light emitter can be positioned in one or the other void 310 or 315.

An optical element 320 may also be provided in the lens cavity 308. The optical element 320 may be a separate component that is attached to the lens 300 within the lens cavity 308 or alternatively may be shaped when forming the lens cavity 308. The optical element 320 may have any desired shape not inconsistent with the objectives of the present invention to capture and direct light in a preferred light direction.

Figure 8:
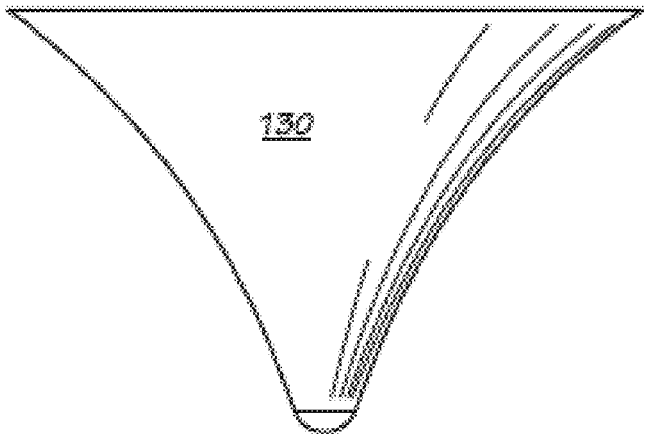
FIGS. 8, 8A, 9, 9A, 10 and 10A-show views of various shape geometries that embodiments of optical elements can assume.
Figure 8A:
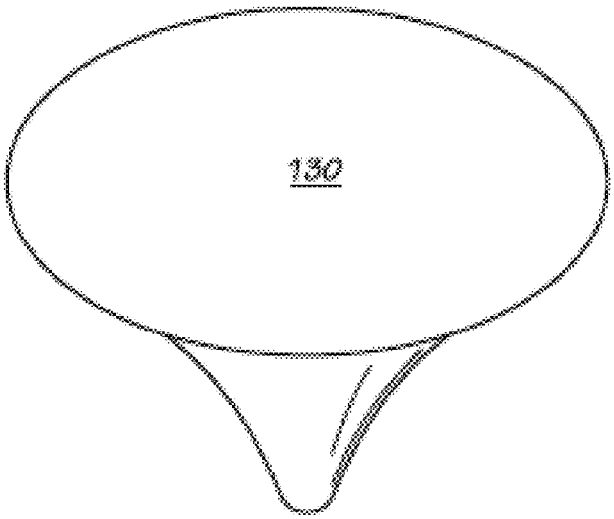
Figure 9:
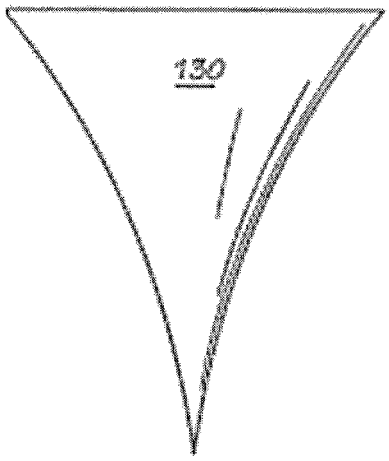
Figure 9A:
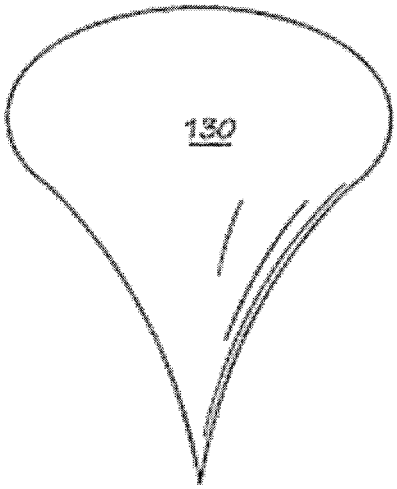
Figure 10:
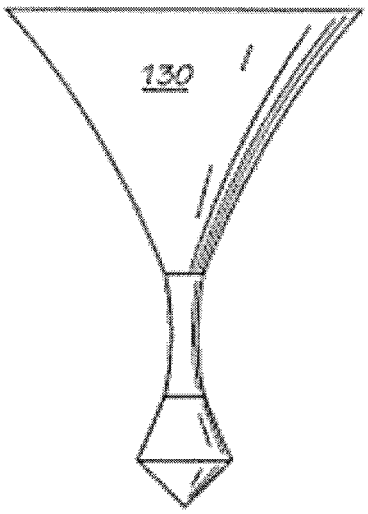
Figure 10A:
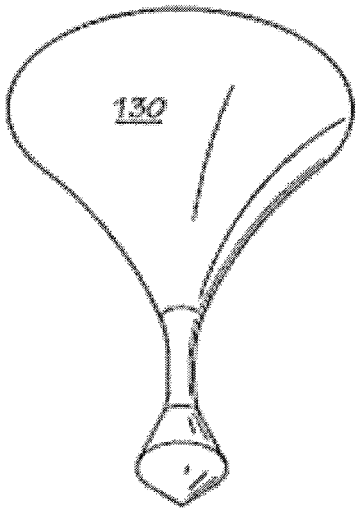

FIGS. 8, 8A, 9, 9A, 10 and 10A illustrate in isolation various non-limiting shape geometries that optical element 320 may assume according to some embodiments. In particular, the optical element 320 may include a conical shape with a tapered side and smooth distal tip (FIGS. 8 and 8A), a conical shape with a tapered side and pointed distal tip (FIGS. 9 and 9A) or a modified hourglass shape (FIGS. 10 and 10A).

Figure 11:
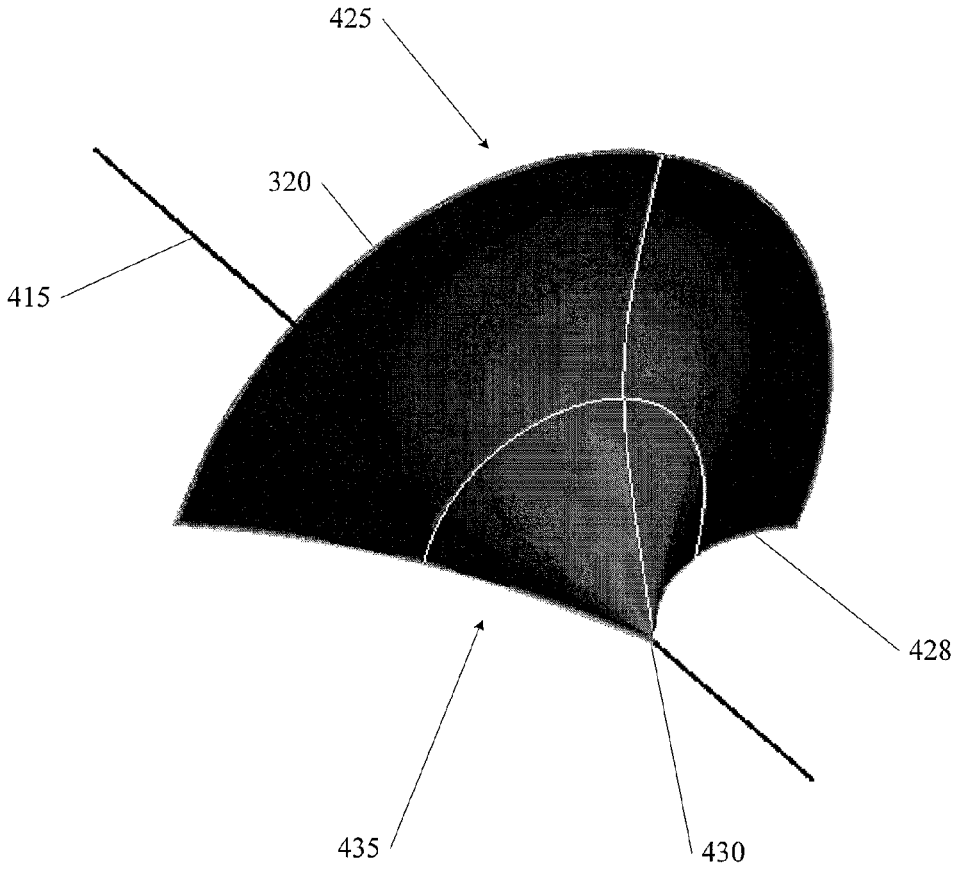
FIG. 11 is a bottom perspective view of an embodiment of an optical element in isolation.

Note, however, that the optical element 320 need not, and often will not, include the entirety of a shape geometry, such as those shown in FIGS. 8-10. For example, only a portion of such shapes may form the optical element 320 that is formed or otherwise provided in the lens cavity 308. FIG. 7 shows an embodiment of a lens 300 having an optical element 320 provided in the lens cavity 308, and FIG. 11 shows the optical element 320 of FIG. 7 in isolation. The optical element 320 of FIG. 11 has a substantially conical shape with an upper plane 425, a flat side wall 435, and a curved side wall 428 that tapers downwardly from the upper plane 425 into a distal tip 430. Axis 415 extends through tip 430. Optical element 320 of FIG. 11 is similar to the shape of FIG. 7 if such shape was sliced longitudinally down the middle (thereby creating flat side wall 435). Again, however, the optical element 320 may be of any shape and/or dimension. For example, upper plane 425 can azimuthally circumscribe a semi-circle or circle around axis 415. Upper plane 425 may also include an ellipse or semi-ellipse with axis 415 extending through one foci of the ellipse or through the center of the ellipse.

In some embodiments, at least one surface of the optical element 320 may be reflective. In some embodiments, such surface may have a surface reflectivity between 90%-99.5%, inclusive; possibly 93%-96%, inclusive; and more preferably 98.5%-99%, inclusive. Such reflectivity may be achieved by forming the optical element 320 from a highly reflective material or alternatively treating the surface of the optical element 320 so as to achieve such reflectivity.

As seen in FIG. 7, optical element 320 extends downwardly into the lens cavity 308. In some embodiments, axis 415 can be parallel with the axis of the light emitter and/or lens 305. In other embodiments, axis 415 and the light emitter axis can be the same axis and/or lens 305.

While certainly not required, at least a portion of optical element 320 may reside in the non-preferred-side void 315 (as shown in FIG. 7) so as to be available to redirect light emitted into the non-preferred-side void 315, as discussed below. In this embodiment, the flat side wall 435 of optical element 320 abuts the plane 312 that separates non-preferred-side void 315 and preferred-side void 310.

Figure 12:
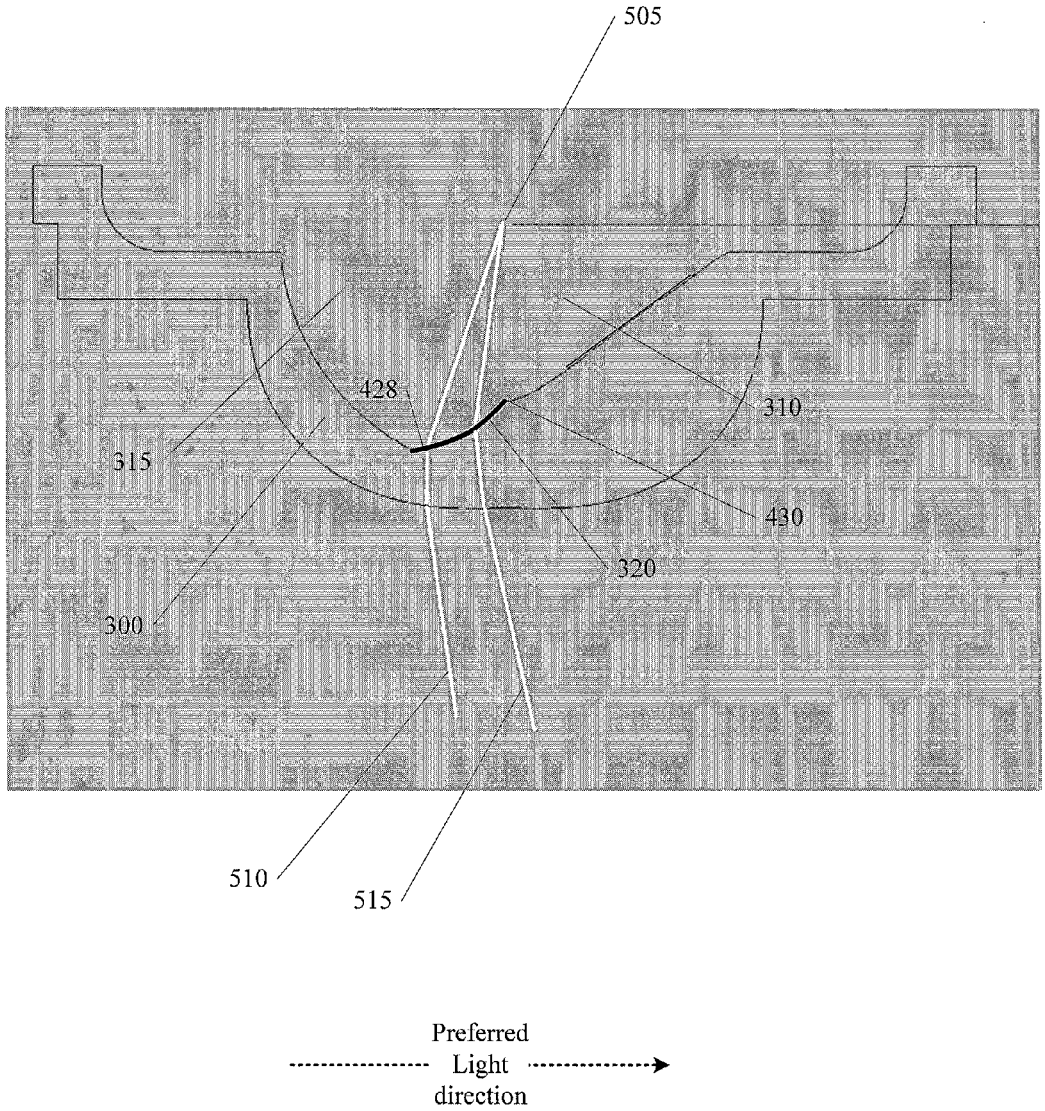
FIG. 12 is a cross-sectional view of the lens of FIG. 7 positioned over a light emitter.

As shown in FIG. 12, optical element 320 can direct light from a light source (e.g., LED) that is emitted into the non-preferred direction (i.e., in the non-preferred-side void 315) back toward the preferred light direction. Light emitter 505 can produce light following light rays 510 and 515. These light rays can pass through lens 300. In particular, these light rays pass through optical element 320. Light rays 510 and 515 are originally directed into non-preferred-side void 315 but impinge optical element 320 that, in turn, refracts light rays 510 and 515 so that they exit lens 300 in the preferred direction.

Figure 13:
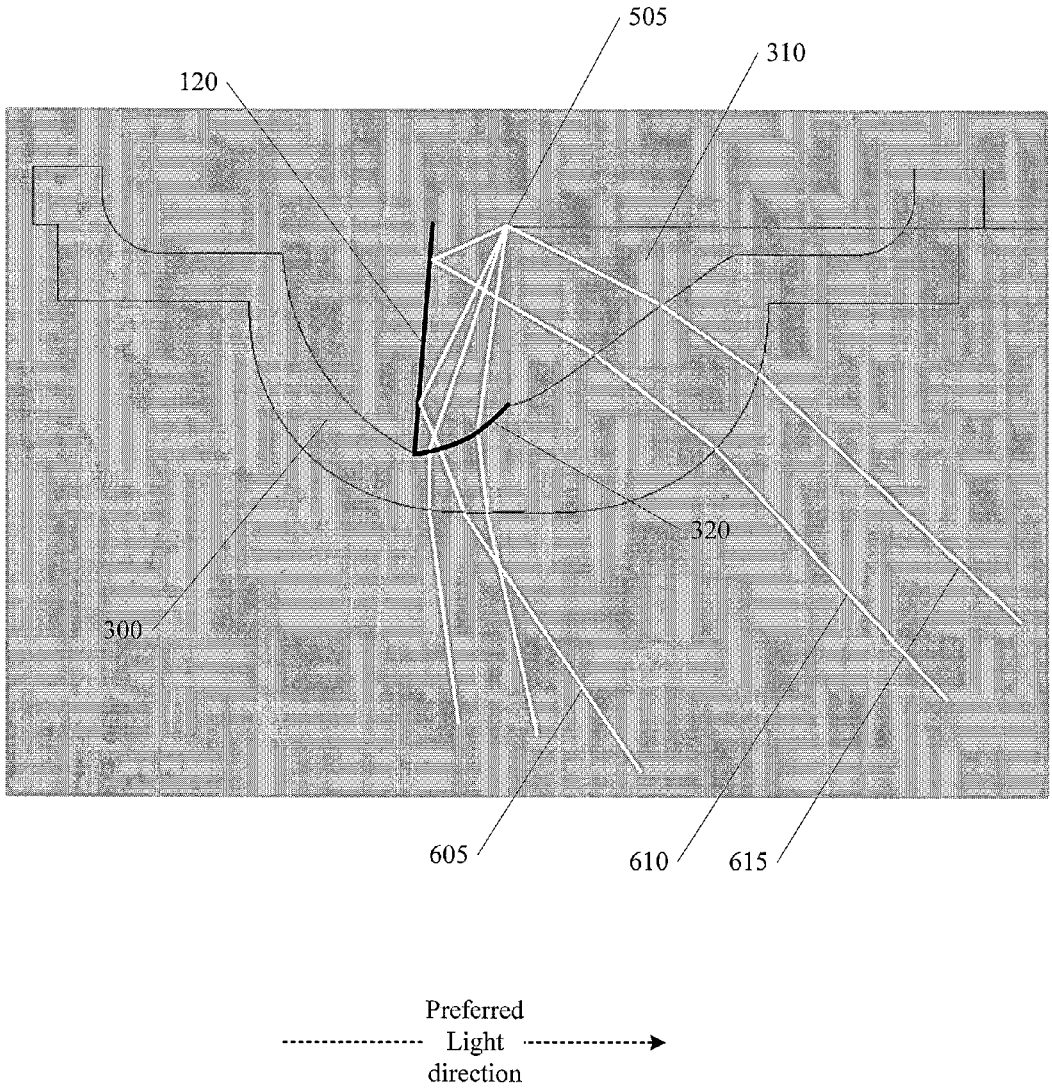
FIG. 13 is a cross-sectional view of an alternative embodiment of an LED assembly that includes the lens of FIG. 7 and a reflector.

FIG. 13 shows ray traces from a light emitter 505 emitted through lens 300 having both optical element 320 and reflector 120, according to some embodiments of the invention. In particular, light ray 605 is reflected off reflector 120 and is refracted via optical element 320. The combined reflection and refraction directs the light in the preferred light direction. As discussed above, in some embodiments reflector 120 is attached directly to a circuit board and is not supported by the lens.

Light rays 610 and 615 are refracted through lens 300 in the preferred light direction. Light ray 615 enters preferred-side void 310 prior to being refracted through lens 300. Light ray 610 is reflected off of reflector 120, enters preferred-side void 310, and exits after being refracted through lens 300.

Figure 14:
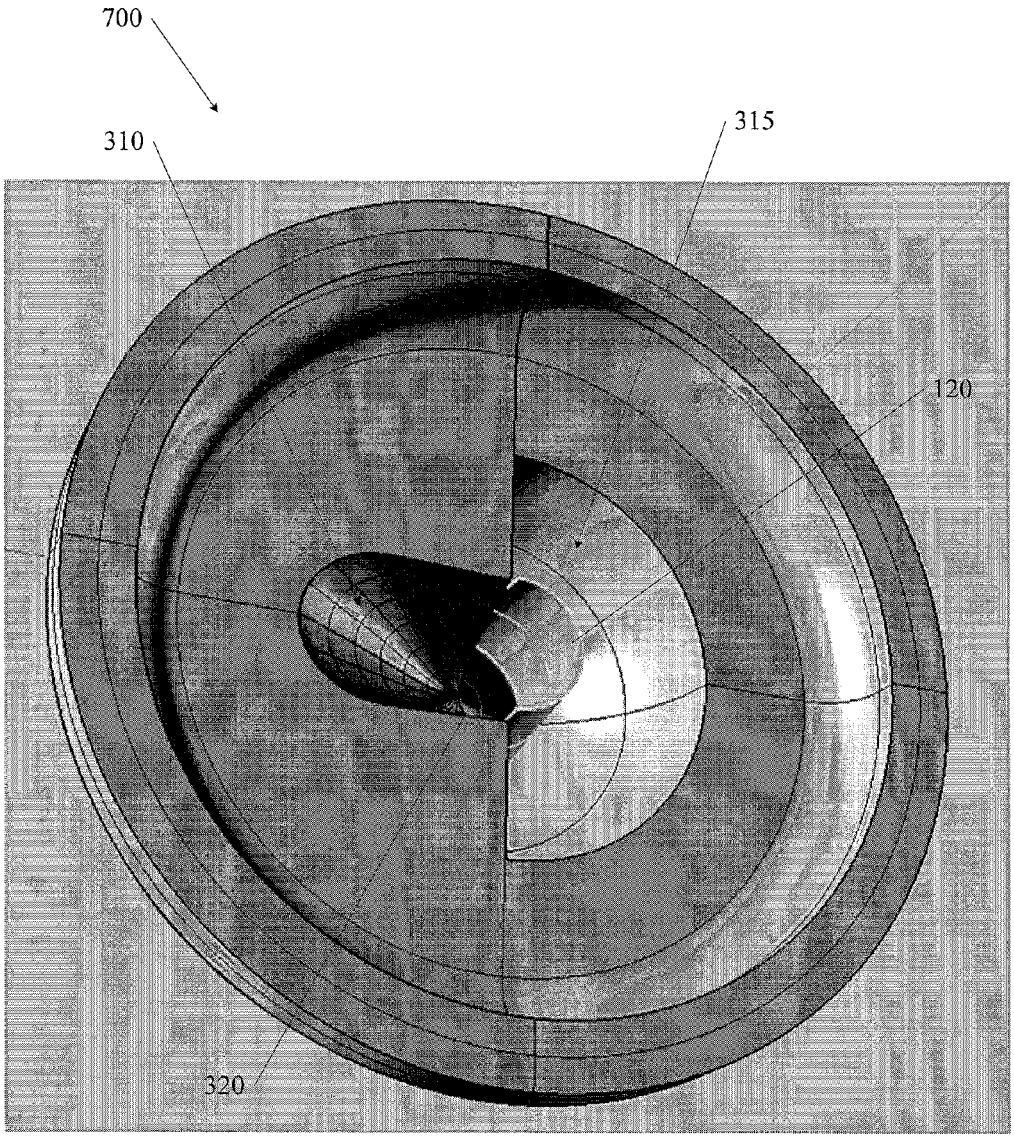
FIG. 14 is a bottom perspective view of the lens and reflector shown in FIG. 13.

FIG. 14 shows an embodiment of a lens 700 having curved reflector 120 and optical element 320 disposed within non-preferred-side void 315. Light may pass through either preferred side void 310 or optical element 320, depending on the longitudinal angle of incident on reflector 120. For example, high angle light (relative to the vertical axis of light emitter 505) will reflect off reflector 120 and exit through lens 700. Low angle light will reflect off reflector 120 and exit through optical element 320.

The terms "invention," "the invention," "this invention" and "the present invention" used in this patent are intended to refer broadly to all of the subject matter of this patent and the patent claims below. Statements containing these terms should not be understood to limit the subject matter described herein or to limit the meaning or scope of the patent claims below. Embodiments of the invention covered by this patent are defined by the claims below and not by the brief summary and the detailed description.

Different arrangements of the components depicted in the drawings or described above, as well as components and steps not shown or described are possible. Similarly, some features and subcombinations are useful and may be employed without reference to other features and subcombinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications can be made without departing from the scope of the claims below.

What is claimed is:

1. A light assembly for distributing light toward a preferred side, the light assembly comprising:

a light emitter mounted on a circuit board and having an emitter axis oriented outwardly from and normal to the circuit board; wherein the preferred-side and a non-preferred-side are separated by a plane that includes the emitter axis; and a lens positioned proximate the light emitter, the lens comprising:

a convex outer surface, and a concave inner surface more proximate the light emitter than the outer surface, wherein:

a lens cavity exists between the circuit board and the inner surface, and the lens cavity comprises a preferred-side void substantially within the preferred side and a non-preferred-side void substantially within the non-preferred side;

an optical element within the non-preferred-side void that is shaped to refract light emitted from the light emitter toward the non-preferred side so that the refracted light exits the lens toward the preferred side; and a reflector positioned within the lens cavity, wherein the reflector extends at least partially around the light emitter;

wherein the light emitted from the light emitter toward the non-preferred side comprises a first portion and a second portion, the optical element is adapted to refract the first portion of light so that the first portion of light exits the lens toward the preferred side, and the reflector is adapted to reflect the second portion of light so that the second portion of light exits the lens toward the preferred side.

2. The light assembly of claim 1, further comprising a circuit board, wherein the reflector is coupled to the circuit board.

3. The light assembly of claim 1, wherein the reflector is positioned within the non-preferred-side void.

4. The light assembly of claim 1, wherein the light emitted from the light emitter toward the non-preferred side further comprises a third portion, wherein the reflector is adapted to reflect the third portion of light toward the optical element and wherein the optical element is adapted to refract the reflected third portion of light so that the third portion of light exits the lens toward the preferred side.

5. The light assembly of claim 1, wherein the optical element is disposed adjacent the lens along a flat surface.

6. The light assembly of claim 5, wherein the flat surface lies along the plane that includes the emitter axis.

7. The light assembly of claim 1, wherein the preferred-side void and the non-preferred-side void are contiguous.

8. A light assembly for distributing light toward a preferred side, the light assembly comprising:

a light emitter mounted on a circuit board and having a light emitter axis oriented outwardly from and normal to the circuit board; wherein the light emitter axis lies within a plane that forms a boundary between the preferred side and a non-preferred side; and a lens positioned over the light emitter, the lens having an outer surface and an inner surface that defines a lens cavity, wherein an optical element extends within the lens cavity from the inner surface toward the light emitter, and is shaped to refract light emitted from the light emitter toward the non-preferred side so that the refracted light exits the lens toward the preferred side, the optical element comprising at least one optical element surface that extends from the inner surface toward the light emitter, the optical element terminating in a tip.

9. The light assembly of claim 8, wherein the optical element is formed integrally in the lens.

10. The light assembly of claim 8, wherein the at least one optical element surface forms a single curve that is concave with respect to the light emitter, as it extends from the inner surface to the tip.

11. The light assembly of claim 8, wherein the optical element tapers radially about an optical element axis that extends through the tip, and wherein the optical element axis is coaxial with the light emitter axis.

12. The light assembly of claim 8, wherein the optical element comprises an axis that extends through the tip, wherein the optical element axis extends parallel to but offset from the light emitter axis.

13. The light assembly of claim 8, further comprising a reflector positioned within the lens cavity, wherein the reflector extends at least partially around the light emitter.

14. The light assembly of claim 13, wherein the reflector is coupled to the circuit board.

15. The light assembly of claim 13, wherein the light emitted from the light emitter toward the non-preferred side comprises a first portion and a second portion, wherein the optical element is adapted to refract the first portion of light so that the first portion of light exits the lens toward the preferred side and wherein the reflector is adapted to reflect the second portion of light so that the second portion of light exits the lens toward the preferred side.

16. The light assembly of claim 13, wherein the light emitted from the light emitter toward the non-preferred side further comprises a third portion, wherein the reflector is adapted to reflect the third portion of light toward the optical element and wherein the optical element is adapted to refract the reflected third portion of light so that the third portion of light exits the lens toward the preferred side.

17. A device for the distribution of light toward a preferred side, comprising:

a light emitter having an emitter axis that extends through a plane that forms a boundary between the preferred side and a non-preferred side; and a lens positioned over the light emitter, the lens having a hemispherical outer surface and an inner surface, wherein:

on the non-preferred side, a first surface portion of the inner surface forms a semi-hemispherical cross-sectional shape having a radius of curvature about the light emitter, and a second surface portion of the inner surface is an axially inward protrusion from the first surface portion and forms a tip at the emitter axis, the second surface portion being radially symmetric about the emitter axis, and radially proximal to the emitter axis with respect to the first surface portion of the inner surface, such that the protrusion formed by the second surface portion extends radially and axially inward from the first surface portion, toward the light emitter, to the tip;

on the preferred side, a third surface portion of the inner surface is a planar surface perpendicular to the emitter axis, and a fourth surface portion of the inner surface forms a recess in the third surface portion that extends radially and axially outward from the light emitter with respect to the third surface portion, the fourth surface portion forming a semi-ovoid cross-sectional shape oriented such that:

a first axis of the semi-ovoid is perpendicular to the emitter axis toward the preferred side, and a second axis of the semi-ovoid is along the emitter axis; and the inner surface forms one or more planar surfaces along the plane that forms the boundary between the preferred side and a non-preferred side, and is bounded by the first, second, third and fourth surface portions.

18. The device for the distribution of light according to claim 17, wherein the second surface portion of the inner surface comprises a funnel shape.

* * * * *